United States Patent [19]

Francis

[11] Patent Number: 4,979,904

[45] Date of Patent: Dec. 25, 1990

[54] GROUNDING DISC

[75] Inventor: Leonard J. Francis, Waterbury, Conn.

[73] Assignee: Litton Systems, Inc., Watertown, Conn.

[21] Appl. No.: 465,348

[22] Filed: Jan. 16, 1990

[51] Int. Cl.[5] ..... H01R 4/66

[52] U.S. Cl. ..... 439/108; 439/620

[58] Field of Search ..... 439/108, 620

[56] References Cited

U.S. PATENT DOCUMENTS 4,440,463 4/1984 Gliha et al. ..... 439/620 X 4,582,385 4/1986 Couper et al. ..... 439/620 X

*Primary Examiner*—Eugene F. Desmond

*Attorney, Agent, or Firm*—Brian L. Ribando

[57] ABSTRACT

A grounding disc which provides a common ground for an array of electrical contacts in a cylindrical connector includes a pattern of press fit holes which match the array of electrical contacts. Each press fit hole grippingly engages an electrical contact to establish a secure electrical and mechanical connection therewith without the use of solder or other mechanical fasteners.

2 Claims, 2 Drawing Sheets

GROUNDING DISC

The invention relates to a grounding disc for an array of contacts in a multicontact electrical connector.

BACKGROUND OF THE INVENTION

Multicontact connectors comprising a cylindrical connector shell which houses an insert containing a plurality of electrical contacts are well known in the art. Such electrical connectors are used to provide a separable connection for a number of electrical circuits which may carry power or signals between two points. In certain situations, it may be desirable to create a common ground between some of the contacts which comprise the electrical connector. In the past, the common ground has been established through the use of a separate wire which had to be mechanically and electrically coupled to each of the ground contacts. The operation of attaching the wire to the contacts is labor intensive, thus adding to the cost of the connector; and the wire itself is subject to breakage, thus rendering the connector unsuitable for its intended use.

There is, accordingly, a need in the art for a connector structure which provides a simple and cost efficient means of creating a common ground between a preselected array of connector contacts.

SUMMARY AND OBJECTS OF THE INVENTION

According to the invention, a grounding disc is used to ground together a preselected array of electrical contacts. The disc comprises a conductive material having contact receiving apertures formed therein allowing the disc to be press fit over the contact array to form a secure mechanical and electrical connection therewith.

It is, accordingly, an object of the invention to provide a grounding disc comprising a conductive disc of material having an array of contact receiving apertures formed therein.

It is another object of the invention to provide a grounding disc having contact receiving apertures which allow the disc to be press fit onto an array of contacts.

These and other objects of the invention will become apparent from the following detailed description in which numerals used throughout the description correspond to reference numerals found on the drawing figures.

DESCRIPTION OF THE PREFERRED EMBODIMENT

Figure 1:
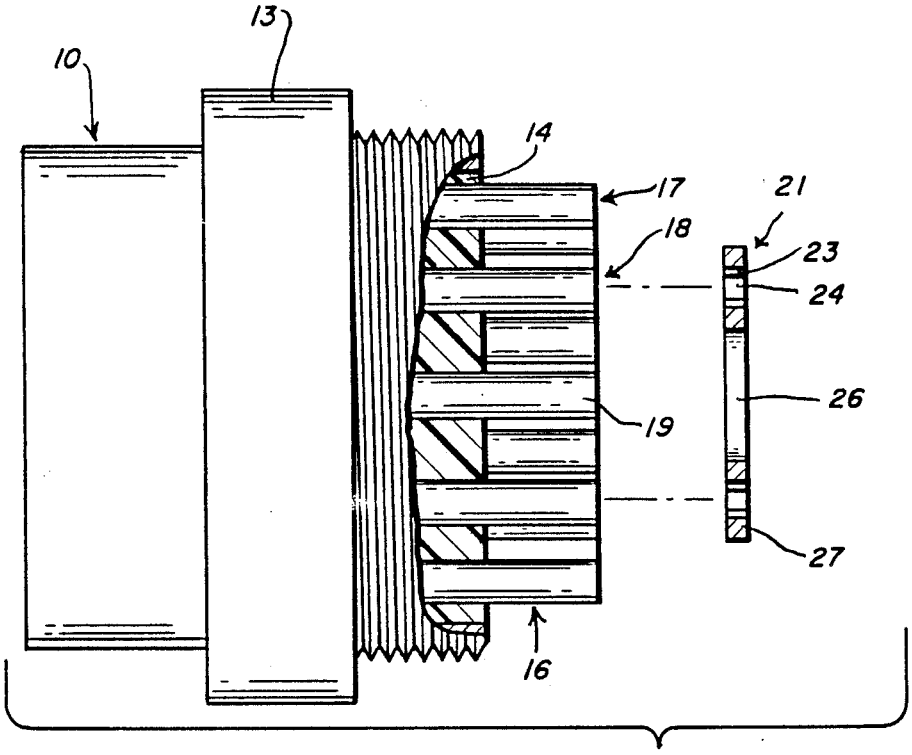
FIG. 1 is an exploded side view of a multicontact electrical connector with a grounding disc.
Figure 4:
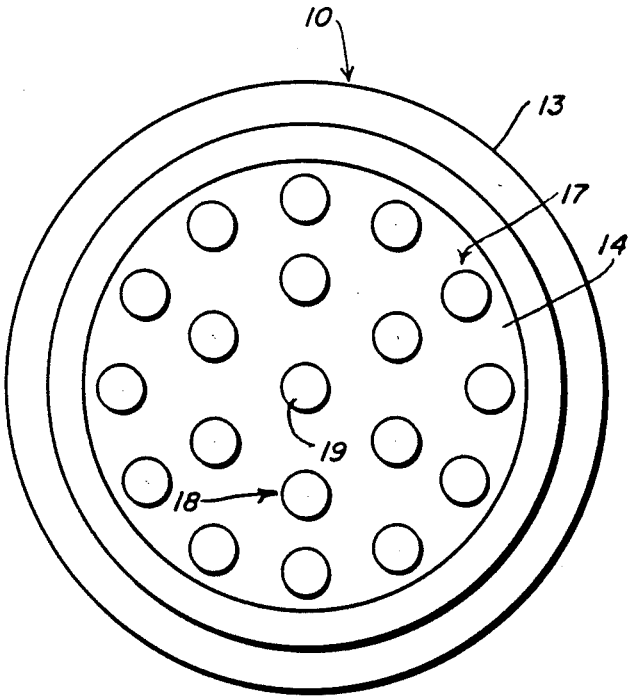
FIG. 4 is a front view of a multicontact electrical connector without a grounding disc.

Turning now to the drawing figures, FIGS. 1 and 4 shows a multicontact connector generally designated by the reference numeral 10. The connector comprises a cylindrical connector shell 13 having a nonconductive insert 14 mounted therein. A plurality of electrical contacts 16 are mounted in the insert and are arranged in an outer ring of contacts 17, an inner ring of contacts 18, and a central contact 19.

Figure 2:
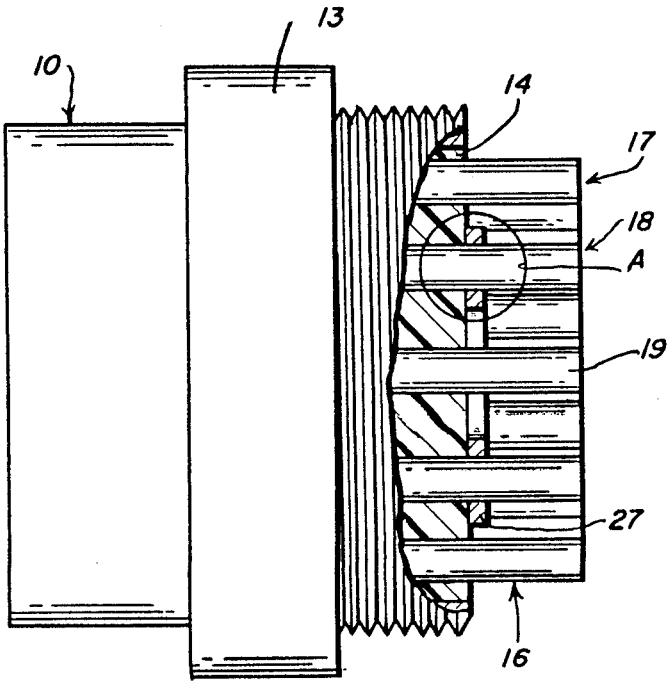
FIG. 2 is a side view of the multicontact electrical connector of FIG. 1.
Figure 3:
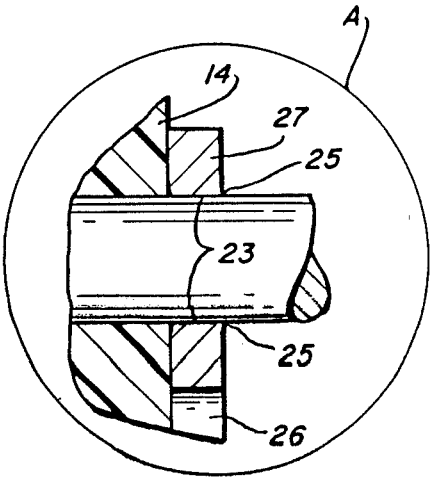
FIG. 3 is an enlarged view of detail A of FIG. 2.
Figure 5:
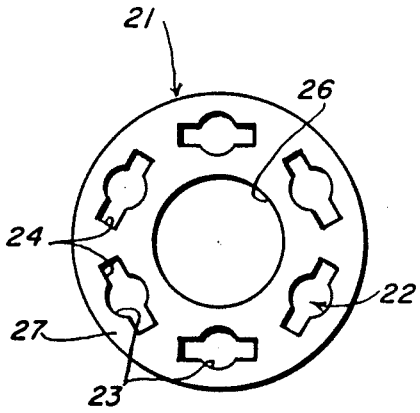
FIG. 5 is a front view of a grounding disc.
Figure 6:
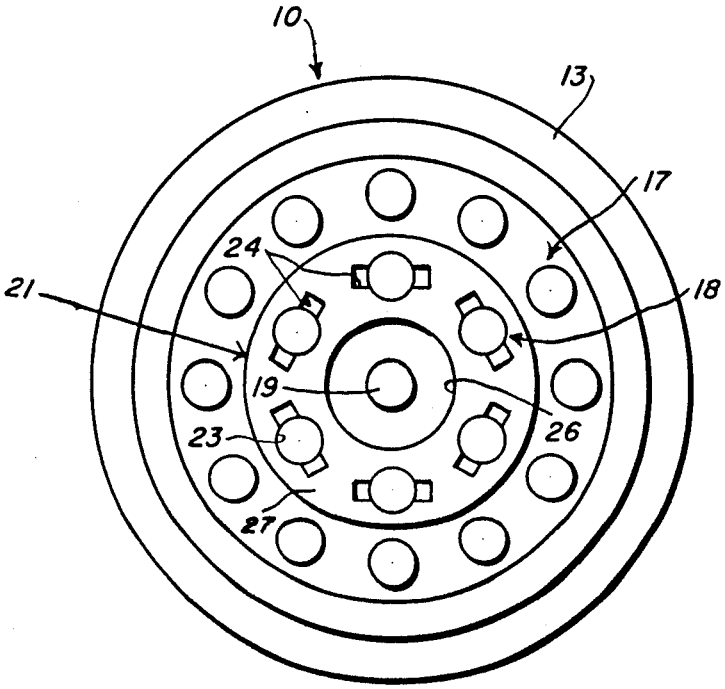
FIG. 6 is a front view of the multicontact electrical connector of FIG. 2.

FIG. 1 shows a grounding disc 21 comprising a disc of conductive material in exploded relation to the insert 14; and when assembled to the connector 10, as shown in FIGS. 2 and 6, the disc mounts on the inner ring of contacts 18. Accordingly, the grounding disc 21 includes a pattern of press fit holes 22 which are positioned to match the array of contacts 18 which form the inner ring. Each press fit hole 22 comprises a contact aperture 23 and a relief notch 24 formed on either side thereof best seen in FIG. 5. The contact aperture is dimensioned to grippingly receive the contacts 16 comprising the array 18; and as shown in FIG. 3, the two relief notches 24 formed on either side of the contact aperture 23 allow the corner of metal 25 at the junction of the aperture 23 and the notch 24 to deflect slightly in order to permit insertion of the electrical contacts 16 therein. The grounding disc 21 also includes a central aperture 26 which is dimensioned to allow passage of the central contact 19 therethrough without making physical or electrical contact therewith. The outer diameter 27 of the grounding disc is dimensioned to fit within the outer ring of electrical contacts 17 without making contact therewith. The material used for the grounding disc 21 may comprise phosphorous bronze or beryllium copper or other suitable conductive material well known to those skilled in the art.

Although not shown, the grounding disc may be formed in other shapes such as oval, square, rectangular, or the like in order to fit onto the particular electrical connector and to make the desired connection with those electrical contacts which are to be grounded together. Also, the grounding disc may be formed without the central aperture 26 in the event the particular connector does not include a central contact 19.

Having thus described the invention, various modifications and alterations will occur to those skilled in the art, which modifications and alterations are intended to be within the scope of the invention as defined by the appended claims.

What is claimed:

1. A grounding disc which provides a common ground for selected ones of an array of electrical contacts in an electrical connector comprising:

an array of electrical contacts comprising a first group of electrical contacts and a second group of electrical contacts;

a conductive disc having a pattern of press fit holes formed therein, the pattern of press fit holes matching the first group of electrical contacts, each press fit hole comprising a contact aperture which is dimensioned to grippingly receive one of the first group of electrical contacts whereby an electrical and mechanical connection is established between the grounding disc and the first group of electrical contracts without the use of solder or other mechanical fasteners; and a pair of reliefs formed in the conductive disc for each contact aperture, each relief comprising a notch formed in the conductive disc which intersects a contact aperture and allows the conductive disc to deform in order to receive an electrical contact, the pair of reliefs being positioned on opposite sides of the contact apertures.

2. The grounding disc of claim 1 further comprising:

an outer ring of contacts surrounding an inner ring of contacts, wherein the inner ring of contacts comprises the first group of electrical contacts and the outer ring of contacts comprises the second group of electrical contacts; and a central aperture formed in the conductive disc, wherein the central aperture provides passage for an electrical contact surrounded by the inner ring of contacts without making an electrical or mechanical connection therewith.

* * * * *